US007279453B2

(12) United States Patent
Blank et al.

(10) Patent No.: US 7,279,453 B2
(45) Date of Patent: Oct. 9, 2007

(54) FOAM REGULATING GRANULATE

(75) Inventors: Volker Blank, Leverkusen (DE); Rene-Andres Artiga-Gonzalez, Duesseldorf (DE); Ulrich Pegelow, Duesseldorf (DE); Stefan Hammelstein, Duesseldorf (DE); Adolf Wiche, Duesseldorf (DE); Mario Sturm, Duesseldorf (DE)

(73) Assignee: Henkel Kommanditgesellschaft auf Aktien, Dusseldorf (DE)

( * ) Notice: Subject to any disclaimer, the term of this patent is extended or adjusted under 35 U.S.C. 154(b) by 0 days.

(21) Appl. No.: 10/647,165

(22) Filed: Aug. 22, 2003

(65) Prior Publication Data

US 2004/0152615 A1 Aug. 5, 2004

Related U.S. Application Data

(63) Continuation of application No. PCT/EP02/01458, filed on Feb. 13, 2002.

(30) Foreign Application Priority Data

Feb. 22, 2001 (DE) ..... 101 08 459

(51) Int. Cl.
*C11D 11/00* (2006.01)
*C11D 3/00* (2006.01)

(52) U.S. Cl. ..... 510/444; 510/438; 510/349; 510/400; 510/466; 510/499

(58) Field of Classification Search ..... 510/438, 510/349, 400, 466, 499, 444
See application file for complete search history.

(56) References Cited

U.S. PATENT DOCUMENTS

| | | | | |
|---|---|---|---|---|
| 3,933,672 | A * | 1/1976 | Bartolotta et al. | 510/438 |
| 4,372,868 | A | 2/1983 | Saran et al. | |
| 4,414,130 | A * | 11/1983 | Cheng | 510/532 |
| 4,419,260 | A | 12/1983 | Reuter et al. | |
| 4,895,667 | A * | 1/1990 | Fox et al. | 510/515 |
| 5,002,695 | A | 3/1991 | Schulz et al. | |
| 5,415,806 | A * | 5/1995 | Pepe et al. | 8/137 |
| 5,447,651 | A * | 9/1995 | Karpusiewicz et al. | 510/452 |
| 5,516,447 | A | 5/1996 | Bauer et al. | |
| 5,591,705 | A * | 1/1997 | Brinson et al. | 510/276 |
| 5,591,707 | A * | 1/1997 | Raehse et al. | 510/457 |
| 5,846,798 | A | 12/1998 | Paatz et al. | |
| 6,093,218 | A | 7/2000 | Hall et al. | |
| 6,340,662 | B1 | 1/2002 | Millhoff et al. | |
| 6,610,752 | B1 * | 8/2003 | Schmid et al. | 516/117 |

FOREIGN PATENT DOCUMENTS

| | | | |
|---|---|---|---|
| CA | 2 053 900 | | 10/1990 |
| DE | 2 338 468 | | 2/1974 |
| DE | 31 28 631 | A1 | 2/1983 |
| DE | 34 36 194 | A1 | 4/1986 |
| DE | 40 04 687 | A1 | 8/1991 |
| DE | 43 25 881 | A1 | 2/1995 |
| DE | 43 29 463 | A1 | 3/1995 |
| DE | 44 08 360 | A1 | 9/1995 |
| DE | 195 05 690 | A1 | 8/1996 |
| DE | 198 28 080 | A1 | 12/1999 |
| DE | 198 57 204 | A1 | 6/2000 |
| EP | 0071481 | A1 * | 2/1983 |
| EP | 0 097 867 | A2 | 1/1984 |
| EP | 0 037 026 | B1 | 7/1985 |
| EP | 0 337 523 | B1 | 6/1993 |
| EP | 0 309 931 | B1 | 11/1993 |
| GB | 1407997 | * | 10/1975 |
| GB | 2009223 | A * | 6/1979 |
| WO | WO90/13533 | A1 | 11/1990 |
| WO | WO92/11347 | A2 | 7/1992 |
| WO | WO93/01269 | A1 | 1/1993 |
| WO | WO93/04162 | A1 | 3/1993 |
| WO | WO96/26258 | A1 | 8/1996 |
| WO | WO98/09701 | A1 * | 3/1998 |
| WO | WO 00/36063 | A1 * | 6/2000 |
| WO | WO 00/36063 | A1 | 6/2000 |

OTHER PUBLICATIONS

Mackenzie et al., "Differential Thermal Analysis", vol. 82, pp. 420-434 (1962).
"Petroleum waxes; determination of congealing point", Alleiinverkauf der Normen durch Beuth Verlag GmbH, Berlin, DIN ISO 2207, pp. 1-4 (1983).

* cited by examiner

*Primary Examiner*—Lorna M. Douyon
(74) *Attorney, Agent, or Firm*—John E. Drach

(57) ABSTRACT

A process of making particulate foam regulating granulates by spraying an aqueous foam regulating emulsion containing 16% to 70% by weight of a foam regulating active ingredient based on paraffin wax or silicone oil, 2% by weight to 15% by weight of a nonionic and/or anionic emulsifier, and not more than 80% by weight of water onto a solid carrier material, wherein the carrier material comprises an alkali metal carbonate and a Brønsted acid.

17 Claims, No Drawings

FOAM REGULATING GRANULATE

CROSS-REFERENCE TO RELATED APPLICATIONS

This is a continuation application under 35 U.S.C. § 365(c) of International Application No. PCT/EP02/01458, filed Feb. 13, 2002 in the European Patent Office, claiming priority under 35 U.S.C. § 119 of DE 101 08 459.5, filed Feb. 22, 2001 in the German Patent Office.

BACKGROUND OF THE INVENTION

The invention relates to particulate foam regulating agents which can be used in detergents or cleaners, and to a process for their preparation.

The foam-regulating effect of combinations of paraffins with bis-fatty acid amides in aqueous surfactant-containing systems is known. Thus, for example, European patent specification EP 0 309 931 B1 describes particulate foam regulating agents suitable for use in detergents and cleaners which contain a water-soluble surfactant-free carrier material and, adsorbed thereon, a siloxane-free antifoam mixture of 5-60% by weight of soft paraffin and/or hard paraffin, 20-90% by weight of microcrystalline paraffin wax with a certain melting range and 5-20% by weight of a diamide derived from $C_{2-7}$-diamines and $C_{12-22}$-fatty acids in finely divided form. The preparation of such particulate foam regulating agents takes place by means of spray drying an aqueous slurry which comprises the carrier material and the antifoam mixture. The antifoam performance of the antifoam mixture is indicated to be inadequate when it is sprayed onto a particulate detergent.

The use of foam regulating homogeneous mixtures of nonionic surfactant and a foam regulating system which comprises paraffin wax and bis-fatty acid amides for improving the manufacturability and the product properties of extruded detergents and cleaners is known from international patent application WO 96/26258.

German laid-open specification DE 23 38 468 provides a detergent with a content of a silicone antifoam which is protected against interactions with the detergent constituents. To prepare it, aqueous melts which comprise the silicone antifoam and a carrier substance, for example polyglycol, are firstly spray-dried, and the resulting particles are provided with a coating in a fluidized bed of a solid, water-soluble coating material. The coating materials which can be used are customary salts used in detergents, in particular tripolyphosphate or carboxymethylcellulose. Such a multistage preparation process is comparatively technically complex.

German laid-open specification DE 31 28 631 describes the preparation of foam-suppressed detergents with a content of silicone antifoams which are microencapsulated. In this connection, the silicone is dispersed in an aqueous solution of a film-forming polymer and the dispersion—separately from the other detergent constituents dissolved or dispersed in water—is fed via a particular line to the spray-drying plant. The two partial streams are combined in the region of the spray nozzle. Suitable film-forming polymers are, for example, cellulose ether, starch ether or synthetic water-soluble polymers and mixtures thereof. The formation of the microcapsules takes place spontaneously in the spray nozzle or by prior precipitation by adding electrolyte salts to the silicone dispersion. The described process is inevitably connected with the preparation of spray-dried detergents. Transference to detergents and cleaners prepared by other methods, for example by granulation, or even to other fields of use is not possible with this procedure.

European patent application EP 097 867 describes a process for the preparation of microencapsulated antifoam oils by mixing a silicone emulsion with an aqueous solution of carboxymethylcellulose and precipitating the microcapsules by adding electrolytes, in particular polyvalent salts or organic solvents. There are considerable difficulties in homogeneously distributing the small amounts of silicone microcapsules required for adequate foam suppression in a comparatively large amount of washing powder.

German laid-open specification DE 34 36 194 describes a process for the preparation of a pourable antifoam granulate by spray-drying an aqueous antifoam dispersion comprising film-forming polymers. For the purpose of preparing a granulate with a composition of from 1 to 10% by weight of water-insoluble antifoam active ingredient, 0.2 to 2% by weight of a mixture of sodium carboxymethylcellulose and methylcellulose in the weight ratio 80:20 to 40:60, 70 to 90% by weight of inorganic, water-soluble or -dispersible carrier salts, and the remainder water, an aqueous solution comprising 0.5 to 8% by weight of the cellulose ether mixture is swollen at a temperature of from 15 to 60° C. until the viscosity of the solution is at least 75% of the viscosity which is measured for complete swelling of the cellulose ether solution, and then the antifoam active ingredient is dispersed in this solution and, following the addition of the carrier salts and optionally water, the homogenized dispersion is spray-dried. The antifoam active ingredients used are organo-polysiloxanes, paraffins, and mixtures of organo-polysiloxanes and paraffins. The antifoam active ingredient content is 1 to 10% by weight, preferably 3 to 7% by weight. The carrier salt preferably consists of a mixture of sodium silicate, sodium tripolyphosphate and sodium sulfate.

European patent specification EP 0 337 523 B1 discloses a process for the preparation of pulverulent detergents which comprise at least 5% by weight of anionic surfactant, 20-80% by weight of alumosilicate and paraffin wax which is essentially insoluble in water and also anionic and nonionic surfactants, which comprises the simultaneous spraying or subsequent spraying of the paraffin onto the prepared detergent particles as an essential process step. The paraffin wax can here also be used in the form of a mixture with nonionic surfactants.

The variant of spraying the paraffin onto a pre-prepared pulverulent detergent disclosed in the last-mentioned document can only be used with difficulties if it is desired to use the paraffin wax not on its own, but in combination with a bis-fatty acid amide which, as is known, enhances its foam regulating effect. Such bis-fatty acid amides are generally solid at room temperature and have a relatively high melting point, meaning that they, or their combination with the paraffin, can only be handled in liquid and sprayable form at an elevated temperature of, for example, about 140° C. If this temperature is not reached, the pipelines and nozzles used may be blocked by the solidification of the bis-fatty acid amide. It is also disadvantageous that such high temperatures of the spray material may lead to undesired interactions with thermally sensitive constituents of the detergent. In addition, a uniform distribution of the foam regulating system in the detergent is put at risk if, being a spray material heated to high temperatures, it is rapidly cooled after striking the detergent powder.

In international patent application WO 00/36063, it has been proposed to solve this problem through the use of an aqueous foam regulating emulsion which comprises 16% by weight to 70% by weight of foam regulating active ingredient based on paraffin wax and/or silicone oil, 2% by weight to 15% by weight of nonionic and/or anionic emulsifier, and not more than 80% by weight of water. Spraying such emulsions onto solid carrier materials gives very highly effective foam regulators in particle form.

However, the stability of the resulting particles is not always satisfactorily high. Rather, conveyance and transportation of these foam regulating particles may lead to their disintegration into smaller particles or powders which, while still having a good foam-regulating effect, cannot be incorporated directly in a uniform manner into particulate detergents or cleaners.

The problem of inadequate particle stability is solved by the present invention by adapting the carrier material.

DESCRIPTION OF THE INVENTION

The invention provides a particulate foam regulating agent which can be used in detergents or cleaners and comprises foam regulating active ingredient based on paraffin wax and/or silicone oil, nonionic and/or anionic emulsifier and solid carrier material, characterized in that the carrier material comprises alkali metal carbonate and a Brønsted acid.

The invention further provides a process for the preparation of particulate foam regulating granulates by spraying an aqueous foam regulating emulsion which comprises 16% by weight to 70% by weight of foam regulating active ingredient based on paraffin wax and/or silicone oil, 2% by weight to 15% by weight of nonionic and/or anionic emulsifier, and not more than 80% by weight of water onto a solid carrier material, optionally followed by a drying step, which is characterized in that the carrier material comprises alkali metal carbonate and a Brønsted acid.

It is preferred for the Brønsted acid to be in solid form at 25° C. It has a solubility in water of preferably at least 100 g/l at 25° C. It is preferably chosen from the di- and tricarboxylic acids, their acidic salts, the acidic salts of inorganic acids, in particular $NaHSO_4$, $Na_2HPO_4$ and $NaH_2PO_4$, and mixtures thereof. In a preferred embodiment of the invention, the Brønsted acid is citric acid.

The carrier material used in the process according to the invention comprises alkali metal carbonate and a Brønsted acid preferably in weight ratios of from 1:1 to 100:1, in particular from 20:3 to 80:3. The carrier material preferably has 40% by weight to 90% by weight, in particular 60% by weight to 80% by weight, of alkali metal carbonate and 1-20% by weight, in particular 3% by weight to 9% by weight, of a Brønsted acid.

The carrier material here can consist merely of alkali metal carbonate and the Brønsted acid, or may additionally comprise further particulate constituents, detergent or cleaner constituents which are solid and/or formulated in solid form being suitable. These include, for example, customary powders prepared by spray-drying aqueous slurries of their ingredients, solid oxygen-based bleaches, for example alkali metal percarbonates or alkali metal perborates, which may be in the form of so-called monohydrates or tetrahydrates, bleach activators formulated in the form of powders, for example a tetraacetylethylenediamine granulate prepared by the process of European patent EP 0 037 026, anionic surfactant compounds, not prepared by conventional spray-drying, according to international patent application WO 93/04162 with a content of more than 80% by weight, in particular more than 90% by weight, of alkyl sulfate with alkyl chain lengths in the range from $C_{12}$ to $C_{18}$, where the radical essentially consists of inorganic salts and water, enzymes present in granular form, for example an enzyme extrudate prepared by the process of international patent application WO 92/11347 or a multienzyme granulate prepared by the process of German patent application DE 43 29 463, soil release active ingredient formulated in the form of a powder, for example by the process of German patent application DE 44 08 360, pulverulent polycarboxylate cobuilders, for example alkali metal citrate, solid inorganic builder materials, such as zeolite-A, zeolite-P, zeolite-X and crystalline phyllosilicates, and other inorganic salts, such as alkali metal sulfate, alkali metal hydrogencarbonate and alkali metal silicate, and mixtures thereof. Preferably, the carrier material has a combination of alkali metal hydrogencarbonate and alkali metal carbonate, where its weight ratio is preferably 99:1 to 10:90, in particular 95:5 to 50:50. A preferred alkali metal in said salts, like in the alkali metal carbonate, is sodium.

In a preferred embodiment of the process, a formulation granulation is carried out essentially as described in international patent application WO 00/36063 in a granulation mixer in such a way that an amount of from 40 to 110 parts by weight, in particular 60 to 90 parts by weight, of carrier material, which may preferably additionally comprise alkali metal sulfate and/or alkali metal hydrogencarbonate, is intensively mixed and, with granulation, an amount of from 15 to 50 parts by weight, in particular from 25 to 35 parts by weight, of the foam regulating emulsion, optionally heated to a temperature in the range from 70° C. to 180° C., is added. Small amounts of water, preferably not more than 10 parts by weight, in particular 1 to 5 parts by weight, of water can likewise be added if desired, after or preferably prior to the addition of the foam regulating emulsion.

For the purposes of the present invention, a paraffin wax base is understood as meaning a combination of paraffin wax and bis-fatty acid amide. Preferably, a foam regulating emulsion which can be used according to the invention comprises 15% by weight to 60% by weight, in particular 30% by weight to 50% by weight, of paraffin wax or a mixture of paraffin wax and silicone oil, 1% by weight to 10% by weight, in particular 3% by weight to 8% by weight, of bis-fatty acid amide deriving from $C_{2-7}$-diamines and $C_{12-22}$-fatty acids, 2% by weight to 15% by weight, in particular 3% by weight to 10% by weight, of nonionic and/or anionic emulsifier, and not more than 80% by weight, in particular not more than 60% by weight and particularly preferably 20% by weight to 50% by weight, of water.

A foam regulating emulsion based on paraffin wax which can be used according to the invention is preferably prepared by melting on the paraffin wax and the bis-fatty acid amide in the presence of the emulsifier, optionally cooling the melt to at most about 100° C. and stirring it into water. If mixtures of nonionic emulsifier and anionic emulsifier are used, it is preferred to incorporate the nonionic emulsifier as described into the melt of paraffin wax and bis-fatty acid amide, and to add the anionic emulsifier not to the melt, but to the water before it is stirred into the melt. If paraffin wax and bis-fatty acid amide are used in molten, non-cooled form, it is preferred to use cold water with a temperature corresponding at most to room temperature. If the melt is cooled to a temperature of at most about 100° C. prior to being stirred into water, it is preferred to use water with a temperature of from about 50° C. to 80° C. Customary stirring devices are normally adequate for achieving uniform distribution of all components and thus producing the aqueous emulsion which can be used according to the invention; the use of high-speed mixers or homogenizers (for example Ultra Turrax®) is generally not necessary. The additional incorporation of silicone oil is possible at any point in this process. If foam regulating emulsions are to be prepared which comprise silicone oil as the sole foam regulating active ingredient, or in a higher amount compared with the amount of paraffin wax, the silicone oil is preferably firstly mixed with the nonionic and/or anionic emulsifier, part of the quantity of water is added with stirring, giving an emulsion of the water-in-silicone type, further water is added until emulsion inversion arises, the mixture is intensively stirred and then the remaining water is added with stirring. The emulsion obtainable in this way can optionally sometimes have multiple character, i.e. the outer water phase can also contain droplets of the original core emulsion of the water-in-silicone type.

The foam regulating emulsions obtainable in this way which can be used in the process according to the invention are stable and have, at 60° C., preferably viscosities below 2500 mPa·s, in particular in the range from 100 mPa·s to 500 mPa·s, measured, for example, using a Brookfield rotary viscometer, spindle No. 2, 5 revolutions per minute.

The paraffin waxes suitable according to the invention are generally complex substance mixtures without a sharp melting point. They are characterized by usually determining their melting range by differential thermoanalysis (DTA), as described in "The Analyst" 87 (1962), 420, and/or their solidification point. This is understood as meaning the temperature at which the wax passes from the liquid state to the solid state by slow cooling. According to the invention, it is possible to use paraffins which are completely liquid at room temperature, i.e. those with a solidification point below 25° C., and paraffins which are solid at room temperature. Preferably, the paraffin wax is solid at room temperature and is in completely liquid form at 100° C. It is possible to use, for example, the paraffin wax mixtures, known from European patent application EP 0 309 931, comprising, for example, 26% by weight to 49% by weight of microcrystalline paraffin wax with a solidification point of 62° C. to 90° C., 20% by weight to 49% by weight of hard paraffin with a solidification point of 42° C. to 56° C. and 2% by weight to 25% by weight of soft paraffin with a solidification point of from 35° C. to 40° C. Preference is given to using paraffins or paraffin mixtures which solidify in the range from 30° C. to 90° C. In this regard, it should be taken into consideration that paraffin wax mixtures which appear solid at room temperature may also comprise varying proportions of liquid paraffin. In the paraffin waxes which can be used according to the invention, the liquid content at 40° C. is as high as possible, without being 100% at this temperature. Preferred paraffin wax mixtures have a liquid fraction of at least 50% by weight, in particular of from 55% by weight to 80% by weight, at 40° C., and a liquid fraction of at least 90% by weight at 60° C. The temperature at which a liquid fraction of 100% by weight of the paraffin wax is achieved is, for particularly preferred paraffin wax mixtures, still below 85° C., in particular 75° C. to 82° C. In addition, it should be taken into consideration that the paraffins comprise the fewest possible volatile fractions. Preferred paraffin waxes comprise less than 1% by weight, in particular less than 0.5% by weight, of fractions which can evaporate at 110° C. and atmospheric pressure. Paraffin waxes which can be used according to the invention can be obtained, for example, under the trade names Lunaflex® from Fuller, and Deawax® from DEA Mineralöl AG. In place of the paraffin wax, it is also possible to use foam regulating silicone oil or, in particular, mixtures of paraffin wax with foam regulating silicone oil. For the purposes of the present invention, the reference to silicone oil also always means its mixture with finely divided fillers, for example hydrophilic or hydrophobic silicon dioxide, so-called highly dispersed silica. Here, pyrogenic or precipitated, in particular hydrophobicized, silicon dioxide with a surface area of at least 50 $m^2/g$ is particularly preferred, as is commercially available, for example, under the name Aerosil® or Sipernat®. In one embodiment of the invention, silicone oil, for example polydimethylsiloxane, is used in mixtures of paraffin wax and silicone oil preferably in amounts such that the foam regulating emulsion used in the process according to the invention has a content of silicone oil in the range from 0.1% by weight to 10% by weight, in particular 1% by weight to 5% by weight. In a further preferred embodiment of the invention, the foam regulating emulsion to be sprayed onto the carrier material comprises a mixture of silicone oil and paraffin wax in the weight ratio 2:1 to 1:100, in particular 1:1 to 1:10. A foam regulating emulsion used with particular preference comprises 10% by weight to 40% by weight, in particular 15% by weight to 35% by weight, of silicone oil and 50% by weight to 80% by weight of water.

If the foam regulating emulsion which can be used according to the invention comprises paraffin wax, a second component of the antifoam system is preferably formed from bis-fatty acid amides. Suitable bisamides are those derived from saturated fatty acids having 12 to 22, preferably 14 to 18, carbon atoms, and from alkylenediamines having 2 to 7 carbon atoms. Suitable fatty acids are lauric acid, myristic acid, stearic acid, arachidic acid and behenic acid, and mixtures thereof, as are obtainable from natural fats or hydrogenated oils, such as tallow or hydrogenated palm oil. Suitable diamines are, for example, ethylenediamine, 1,3-propylenediamine, tetramethylenediamine, pentamethylenediamine, hexamethylenediamine, p-phenylenediamine and tolylenediamine. Preferred diamines are ethylenediamine and hexamethylenediamine. Particularly preferred bisamides are bis-myristoylethylenediamine, bis-palmitoylethylenediamine, bis-stearoylethylenediamine and mixtures thereof, and the corresponding derivatives of hexamethylenediamine.

Nonionic emulsifiers which can be used in emulsions which can be used according to the invention are, in particular, understood as meaning the alkoxylates, preferably the ethoxylates and/or propoxylates of alcohols, alkylamines, vicinal diols, carboxylic acids and/or carboxamides which have alkyl groups with 8 to 22 carbon atoms, preferably 12 to 18 carbon atoms. The average degree of alkoxylation of these compounds here is usually from 1 to 10, preferably 2 to 5. They can be prepared in a known manner by reaction with the corresponding alkylene oxides. Products which can be prepared by alkoxylation of fatty acid alkyl esters having 1 to 4 carbon atoms in the ester moiety by the process of international patent application WO 90/13533 are also suitable. Suitable alcohol alkoxylates include the ethoxylates and/or propoxylates of linear or branched-chain alcohols having 8 to 22 carbon atoms, preferably 12 to 18 carbon atoms. Suitable are, in particular, the derivatives of fatty alcohols, although their branched-chain isomers can also be used for the preparation of alkoxylates which can be used.

Accordingly, it is possible to use, in particular, the ethoxylates of primary alcohols with linear dodecyl, tetradecyl, hexadecyl or octadecyl radicals, and mixtures thereof. The use of corresponding alkoxylates of mono- or polyunsaturated fatty alcohols, which include, for example, oleyl alcohol, elaidyl alcohol, linoleyl alcohol, linolenyl alcohol, gadoleyl alcohol and erucyl alcohol, is also possible. Esters or partial esters of carboxylic acids of corresponding carbon chain length with polyols such as glycerol or oligoglycerol can also be used. Preferred anionic emulsifiers are alkali metal salts of the alkylbenzenesulfonic acids having 9 to 13 carbon atoms in the alkyl group, in particular sodium dodecylbenzenesulfonate. In addition to such emulsifiers, small amounts, optionally up to 4% by weight, of anionic and/or nonionic cellulose ethers, such as carboxymethylcellulose and/or hydroxyethylcellulose, may be present.

It is essential for the preparation of emulsions which can be used according to the invention that a homogeneous mixture of foam regulating system and, in particular, nonionic emulsifier is used. This can be achieved advantageously in a simple manner by melting on the bisamide solid at room temperature in the presence of the paraffin and of the emulsifier, expediently with stirring or homogenization. If the bisamide is not used without a diluent, but in preformulated form in a mixture with the paraffin, it is generally not necessary to heat beyond the melting point of the bisamide since a solution of the bisamide in the paraffin usually forms even at relatively low temperatures. Following the formation of the mixture of antifoam system and emulsifier, which is preferably undertaken at temperatures in the range from 60° C. to 150° C., in particular 80° C. to 150° C., this mixture, optionally after cooling, is mixed with water, it being possible for an, in particular anionic, emulsifier to have been added to the water beforehand. In this case, the concentration of anionic emulsifier in water is preferably 5% by weight to 15% by weight.

The emulsion obtainable in this way is storage-stable at room temperature, and preferably 3% by weight to 60% by weight, in particular 15% by weight to 45% by weight, of it are applied to the carrier material. After the aqueous emulsion has been sprayed on, a drying step, for example using customary fluidized-bed dryers, can follow, or the emulsion is applied with simultaneous drying, for example likewise in a fluidized bed. The foam regulating granulates obtainable according to the invention or by the process according to the invention preferably comprise 5% by weight to 50% by weight, in particular 8% by weight to 35% by weight, of foam regulating active ingredient.

EXAMPLES 306 parts by weight of a foam regulating emulsion obtained according to WO 00/36063 and comprising 40% by weight of paraffin wax with a solidification point in accordance with DIN ISO 2207 of 45° C. and a liquid fraction at 40° C. of about 66% by weight and at 60° C. of about 96% (Lunaflex®, DEA), 6% by weight of bistearyl acid ethylenediamide, 4.5% by weight of silicone oil, 5.5% by weight of anionic (Na dodecylbenzenesulfonate) and 5% by weight of nonionic (triply ethoxylated $C_{12/14}$-fatty alcohol, Cognis Deutschland GmbH) emulsifier, remainder water were applied, in a mixer, to the initial charge of a combination of sodium carbonate (704 parts by weight) and citric acid (63 parts by weight), to which 30 parts by weight of water had been added beforehand, to form a granulate. This was then dried in a fluidized-bed dryer at 80-90° C. The foam regulating granulate obtained in this way were added, in an amount of in each case 1% by weight, to an antifoam-free particulate detergent which, at washing temperatures of 40° C., 60° C. and 90° C., gave an antifoam performance which was not inferior to those antifoam granulates prepared using a conventional method. It had greater optical stability and a smaller fines fraction than a correspondingly prepared granulate which lacked the Brønsted acid fraction or in which said fraction was replaced by polymeric alkali metal polycarboxylate.

The invention claimed is:

1. A process of making particulate foam regulating granulates, comprising the steps of spraying an aqueous foam regulating emulsion that comprises 15% to 60% by weight of a foam regulating active ingredient based on either or both a paraffin wax or silicone oil, 2% by weight to 15% by weight of a nonionic and/or anionic emulsifier, and not more than 80% by weight of water onto a solid carrier material, optionally followed by a drying step, wherein the carrier material comprises from 60% by weight to 80% by weight of an alkali metal carbonate and from 3% by weight to 9% by weight of a Brønsted acid selected from the group consisting of $NaHSO_4$, $Na_2HPO_4$, $NaH_2PO_4$ and mixtures thereof.

2. The process of claim 1, wherein the Brønsted acid has a solubility in water of at least 100 g/l at 25° C.

3. The process of claim 1, wherein the carrier material additionally comprises further detergent or cleaner constituents which are solid and/or formulated in solid form.

4. The process of claim 1, wherein the aqueous foam regulating emulsion comprises 15% by weight to 60% by weight of paraffin wax or a mixture of paraffin wax and silicone oil, 1% by weight to 10% by weight of bis-fatty acid amide deriving from $C_{2-7}$ diamines and $C_{12-22}$ fatty acids, 2% by weight to 15% by weight of nonionic and/or anionic emulsifier, and not more than 80% by weight of water.

5. The process of claim 4, wherein the aqueous foam regulating emulsion comprises 30% by weight to 50% by weight of paraffin wax or a mixture of paraffin wax and silicone oil.

6. The process of claim 4, wherein the aqueous foam regulating emulsion comprises a mixture of silicone oil and paraffin wax in the weight ratio 2:1 to 1:100.

7. The process of claim 6, wherein the aqueous foam regulating emulsion comprises a mixture of silicone oil and paraffin wax in the weight ratio 1:1to 1:10.

8. The process of claim 4, wherein the paraffin wax is solid at room temperature and is in completely liquid form at 100° C.

9. The process ur claim 8, wherein the paraffin wax has a liquid fraction of at least 50% by weight at 40° C., and a liquid fraction of at least 90% by weight at 60° C.

10. The process of claim 9, wherein the paraffin wax has a liquid fraction of at least 55% by weight at 40° C.

11. The process of claim 4, wherein the aqueous foam regulating emulsion comprises 3% by weight to 8% by weight of bis-fatty acid amide deriving from $C_{2-7}$ diamines and $C_{12-22}$ fatty acids.

12. The process of claim 4, wherein the aqueous foam regulating emulsion has a content of silicone oil in the range from 0.1 by weight to 10% by weight.

13. The process of claim 9, wherein the aqueous foam regulating emulsion has a content of silicone oil in the range from 1% by weight to 5% by weight.

14. The process of claim 4, wherein the aqueous foam regulating emulsion comprises 3% by weight to 10% by weight of one or more nonionic and/or anionic emulsifiers.

15. The process of claim 14, wherein the nonionic emulsifier is selected from the group consisting of alkoxyltates of alcohols alkylamines, vicinal diets, or carboxamides that have alkyl groups with 8 to 22 carbon atoms and whose average degree of alkoxylation is from 1to 10.

16. The process of claim 10, wherein 15to 50 parts by weight of the foam regulating emulsion, optionally heated to a temperature in the range from 70° C. to 180° C., are sprayed onto 40 to 110 parts by weight of carrier material and subjected to granulation in a granulating mixer.

17. Thu process of claim 16, wherein 25 to 35 parts by weight of the foam regulating emulsion, optionally heated to a temperature in the range from 70° C. to 180° C., are sprayed onto 60 to 90 parts by weight of carrier material and subjected to granulation in a granulating mixer.

* * * * *